US011312134B2

(12) United States Patent
Eibl

(10) Patent No.: US 11,312,134 B2
(45) Date of Patent: Apr. 26, 2022

(54) ATTACHMENT DEVICE FOR AN ELECTRONIC ASSEMBLY

(71) Applicant: Canon Production Printing Holding B.V., Venlo (NL)

(72) Inventor: Martin Eibl, Reithofen (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/953,687

(22) Filed: Nov. 20, 2020

(65) Prior Publication Data

US 2021/0154997 A1 May 27, 2021

(30) Foreign Application Priority Data

Nov. 26, 2019 (DE) ..... 102019131972.2

(51) Int. Cl.
*B41J 2/14* (2006.01)

(52) U.S. Cl.
CPC ..... *B41J 2/14* (2013.01); *B41J 2002/14491* (2013.01)

(58) Field of Classification Search
CPC ..... B41J 2/14; B41J 2002/14491
See application file for complete search history.

(56) References Cited

U.S. PATENT DOCUMENTS 3,853,379 A * 12/1974 Goodman ..... H01R 12/89 439/261
2018/0257410 A1* 9/2018 Profaca ..... B41J 2/16505

FOREIGN PATENT DOCUMENTS

DE 2433385 A1 2/1975
JP S47 33843 U 12/1972
WO 2018118036 A1 6/2018

OTHER PUBLICATIONS

IP.com search (Year: 2021).*
German Action dated Aug. 4, 2020, Application No. 10 2019 131 972.2.

* cited by examiner

*Primary Examiner* — Lisa Solomon
(74) *Attorney, Agent, or Firm* — The Webb Law Firm

(57) ABSTRACT

An attachment device for attaching an electronic assembly to a base module (e.g. print head) of a printing device can include a carrier plate of the assembly and a support body of the base module that has a groove into which the carrier plate may be inserted and arrested by means of a latch that engages in a recess of the carrier plate. The attachment device advantageously enables an efficient and reliable attachment of the assembly to the base module.

19 Claims, 4 Drawing Sheets

ATTACHMENT DEVICE FOR AN ELECTRONIC ASSEMBLY

CROSS REFERENCE TO RELATED APPLICATIONS

This patent application claims priority to German Patent Application No. 102019131972.2, filed Nov. 26, 2019, which is incorporated herein by reference in its entirety.

BACKGROUND

Field

The disclosure relates to the efficient and reliable attachment of an electronic assembly to a base module. In particular, the disclosure relates to the attachment of a control assembly to a print head of a printing device.

Related Art

A printing device, in particular an inkjet printing device, for printing to a recording medium may comprise one or more print heads respectively having one or more nozzles. The nozzles are respectively configured to eject ink droplets in order to print dots of a print image onto the recording medium. The one or more print heads and the recording medium are thereby moved relative to one another in order to ink dots onto the recording medium at different positions, in particular in different lines, and in order to thus print a print image onto the recording medium.

The individual print heads are typically controlled via one or more control assemblies of the printing device and supplied with electrical power in order to print a print image onto a recording medium. Given the installation of the one or more control assemblies, and/or for maintenance purposes, it may possibly be necessary to install the individual control assemblies at the print heads and/or to uninstall them from the print heads. This may be linked with a relatively high time cost.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1A:
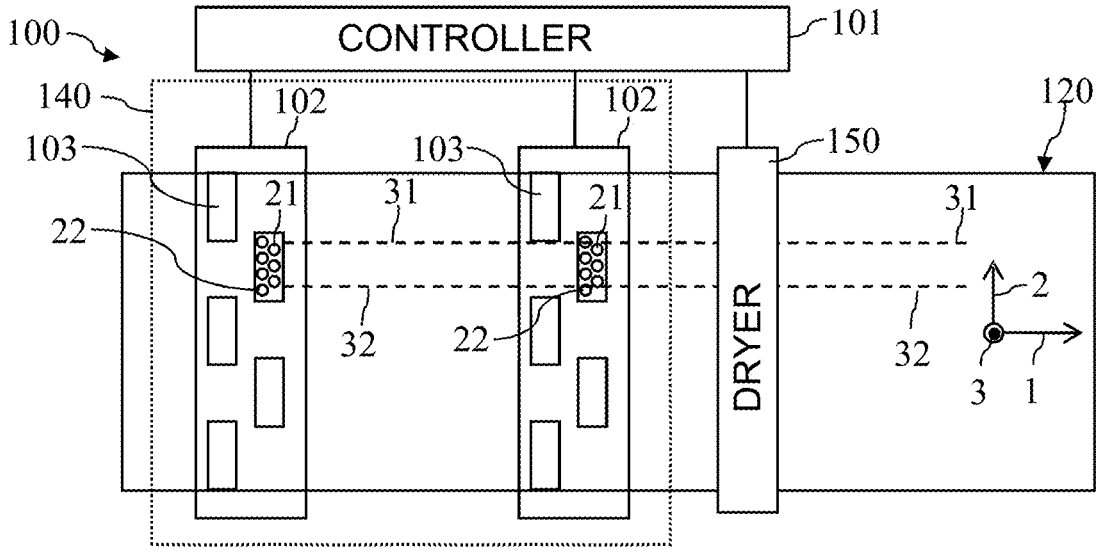

FIG. 1*a* illustrates a block diagram of an example of an inkjet printing device according to an exemplary embodiment.

Figure 1B:
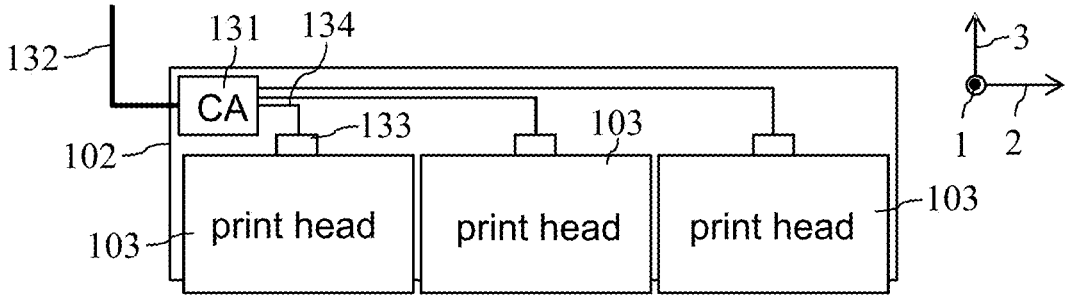

FIG. 1*b* illustrates an example of a print bar having a central control assembly for a plurality of print heads according to an exemplary embodiment.

Figure 2A:
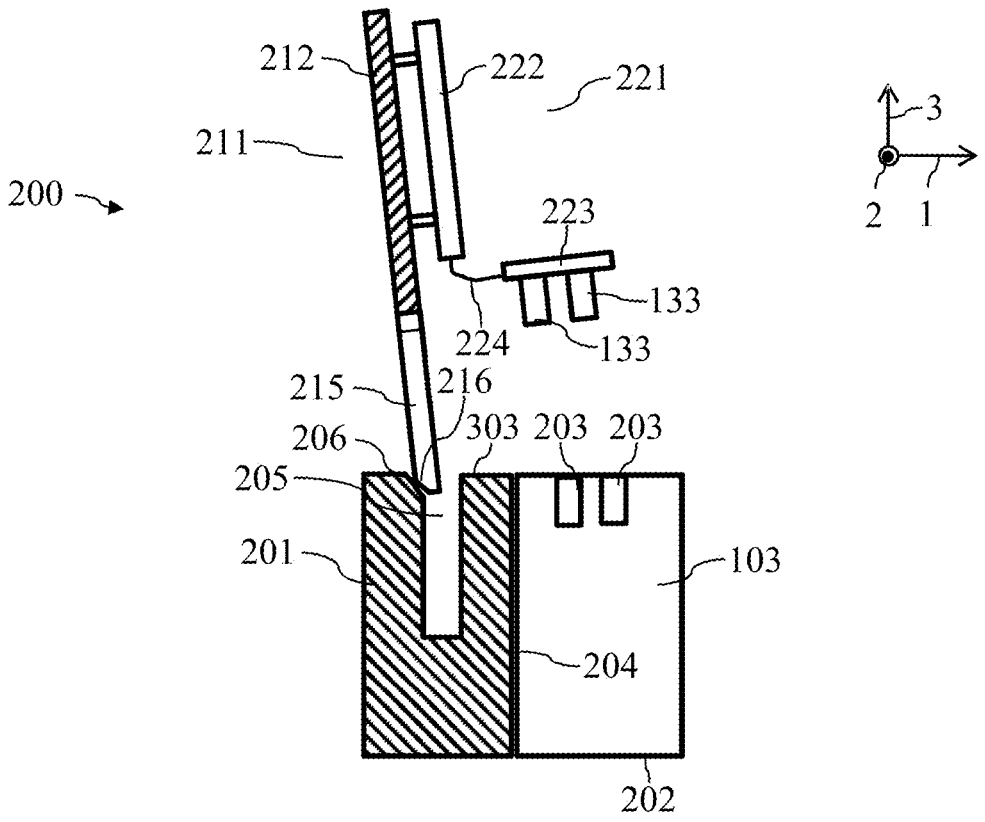

FIG. 2*a* illustrates an example of a carrier plate of a control assembly for attachment of the control assembly to a print head, in a dismounted state, according to an exemplary embodiment.

Figure 2B:
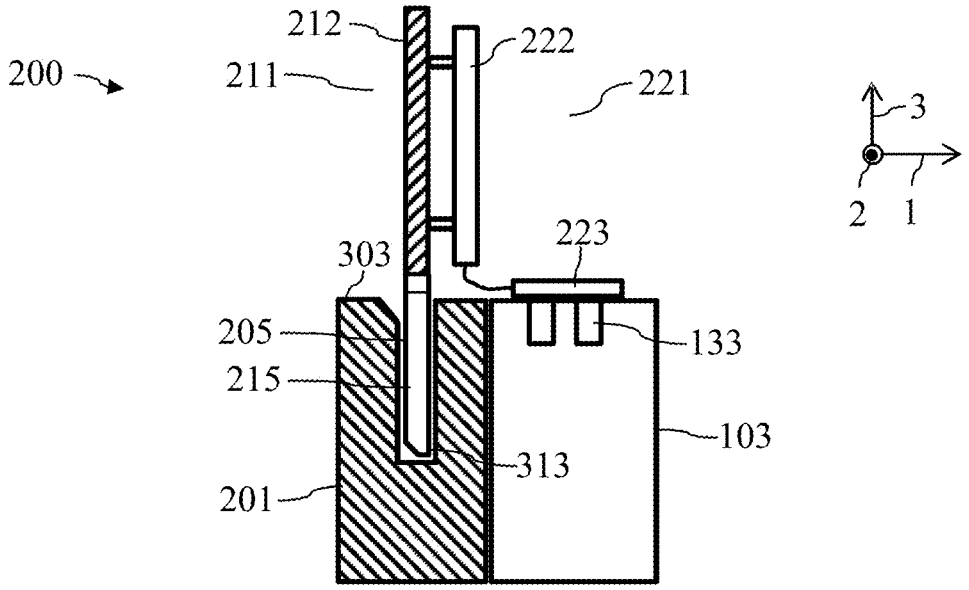

FIG. 2*b* illustrates an example of the carrier plate of a control assembly for attachment of the control assembly to a print head, in an installed or attached state, according to an exemplary embodiment.

Figure 3A:
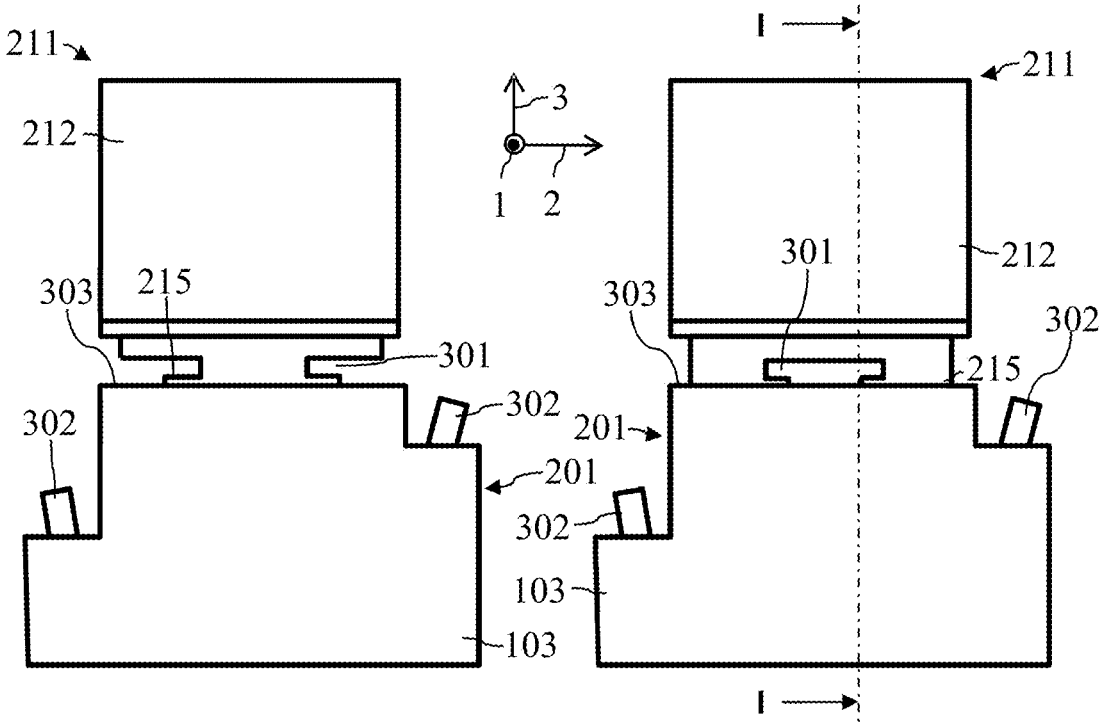
Figure 3B:
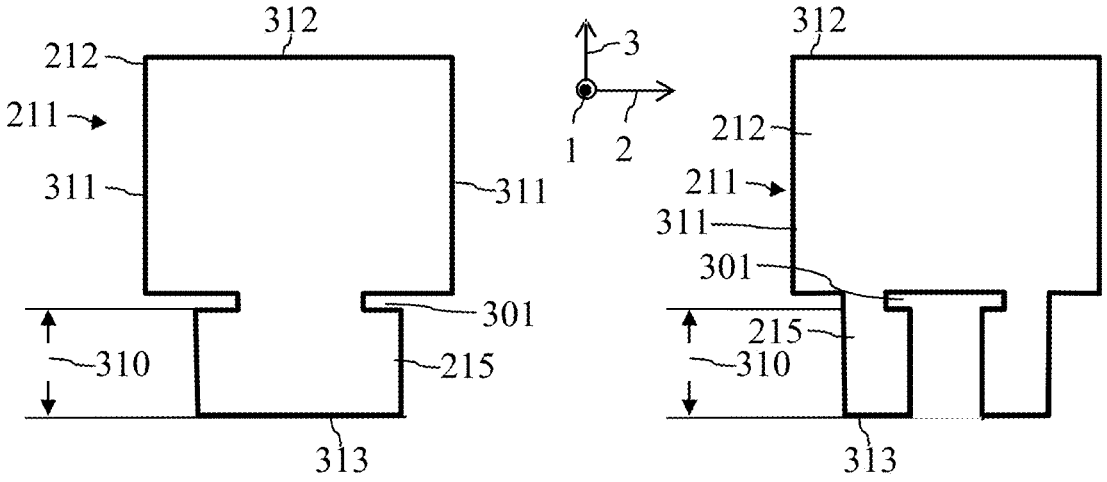

FIGS. 3*a* and 3*b* illustrate examples of the attachment region of the carrier plate, which attachment region can be introduced into a groove of the print head, according to exemplary embodiments.

Figure 3C:
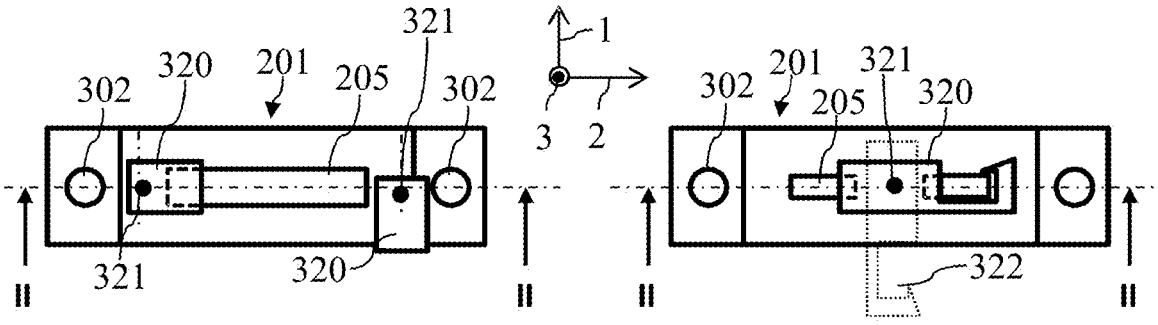

FIG. 3*c* illustrates examples of the groove and of the attachment latch of the print head, in a view from above, according to exemplary embodiments.

Figure 3D:
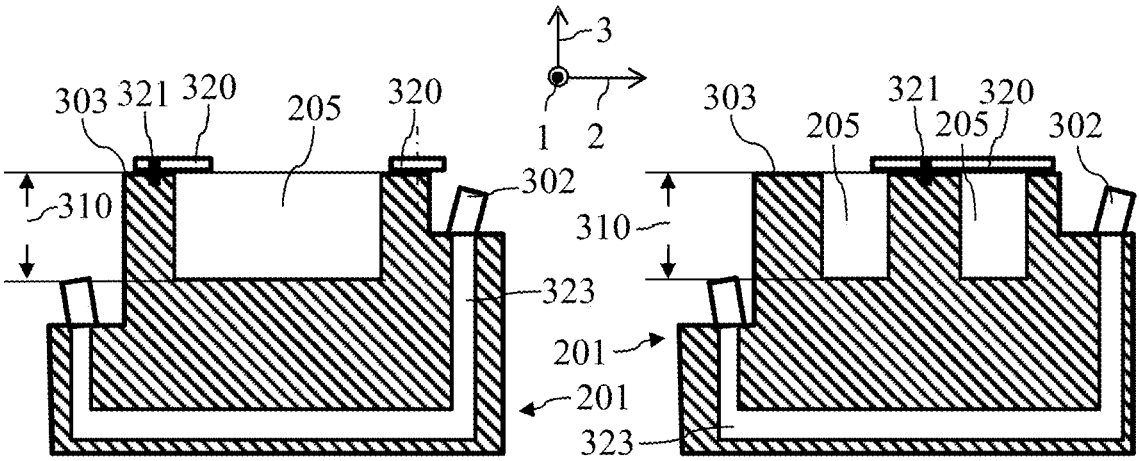

FIG. 3*d* illustrates examples the groove and of the attachment latch of the print head, in a section view, according to exemplary embodiments.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to enable an efficient and reliable attachment of an electronic assembly, in particular a control assembly, to a base module, in particular to a print head.

According to one aspect of the disclosure, an attachment device is described for attaching an electronic assembly to a base module. The attachment device comprises a carrier plate of the electronic assembly or for the assembly, wherein the carrier plate has at least one recess between an attachment region and a retention region of the carrier plate. Furthermore, the attachment device has a support body of the base module or for the base module, wherein the support body has at least one groove that is designed to accommodate the attachment region of the carrier plate and comprises at least one latch attached to the support body so as to be movable, which latch is designed to be moved into the recess for attachment of the carrier plate if the attachment region of said carrier plate is located in the groove of the support body.

Aspects of the disclosure are directed to the attachment of an electronic assembly to a base module, if applicable an electrical and/or electronic base module. The electronic assembly may thereby be designed to interact with the base module and/or to provide a function for the base module. Examples of interactions and/or functions are:

- supplying the base module with electrical power for the operation of said base module;
- transmitting data to the base module and/or from the base module; and/or
- controlling the base module and/or the transmission of control signals to the base module, in particular in order to have the effect that the base module performs a defined task.

In an exemplary embodiment, the base module is a print head of a printing device. In an exemplary embodiment, the electronic assembly is a control assembly for a print head. In the following, aspects of the disclosure are described by way of example for a control assembly and for a print head. It is noted that the described aspects are applicable in general to an electrical assembly and to a base module. In particular, in the following embodiments, the term "print head" may be replaced by the general term "base module", and the term "control assembly" may be replaced by the term "assembly".

The printing device 100 depicted in FIG. 1*a* is designed for printing to a recording medium 120 in the form of a sheet or page or plate or belt. The recording medium 120 may be produced from paper, paperboard, cardboard, metal, plastic, textiles, a combination thereof, and/or other materials that are suitable and can be printed to. The recording medium 120 is directed through the print head 140 of the printing device 100 along the transport direction 1, which is represented by an arrow.

For clarification of the views shown in this document, FIG. 1*a* shows a Cartesian coordinate system with the three axes or directions: transport direction or longitudinal axis 1, transverse direction or transverse axis 2, and height direction or height axis 3.

In the depicted example, the print group 140 of the printing device 100 comprises two print bars 102, wherein each print bar 102 may be used for printing with ink of a defined color, for example black, cyan, magenta, and/or yellow, and if applicable MICR ink. Different print bars 102 may be used for printing with respective different inks. Furthermore, the printing device 100 comprises at least one fixer or dryer 150 that is configured to fix and/or to dry a print image printed onto the recording medium 120.

A print bar 102 may comprise one or more print heads 103 that are arranged side by side in a plurality of rows in order to print the dots of different columns 31, 32 of a print image onto the recording medium 120. In the example depicted in FIG. 1*a*, a print bar 102 comprises five print heads 103, wherein each print head 103 prints the dots of a group of columns 31, 32 of a print image onto the recording medium 120. The number of print heads 103 of a print bar 102 may be 5 or more or 10 or more, for example.

In the embodiment depicted in FIG. 1*a*, each print head 103 of the print group 140 comprises a plurality of nozzles 21, 22, wherein each nozzle 21, 22 is configured to fire or eject ink droplets onto the recording medium 120. A print head 103 of the print group 140 may comprise multiple thousands of effectively utilized nozzles 21, 22, for example, that are arranged along a plurality of rows transverse to the transport direction 1, i.e. along the width or the transverse axis 2 of the recording medium 120.

The printing device 100 also comprises a controller 101, for example a control hardware and/or a controller, that is configured to activate the actuators of the individual nozzles 21, 22 of the individual print heads 103 of the print group 140 in order to apply the print image onto the recording medium 120 depending on print data. In an exemplary embodiment, the controller 101 includes processor circuitry that is configured to perform one or more functions and/or operations of the controller 101. The controller 101 can include a memory that stores executable instructions and/or other data, and a processor. The processor is configured to execute the instructions to perform the functions and/or operations of the controller 101. The controller 101 may be additionally or alternatively configured to access an external memory storing instructions (or otherwise receive instructions from an external source), where these instructions are then executed by the controller 101 to perform the functions/operations of the controller 101.

The print group 140 of the printing device 100 thus comprises at least one print bar 102 having K nozzles 21, 22, wherein the nozzles 21, 22 may be arranged in one or more print heads 103, and wherein the nozzles 21, 22 may be activated with a defined line timing or with a defined activation frequency in order to print a line traveling transverse to the transport direction 1 of the recording medium 120 onto the recording medium 120 with K pixels or K columns 31, 32 of a print image, for example with K>1000. In the depicted example, the nozzles 21, 22 are installed immobile or fixed in the printing device 100, and the recording medium 120 is directed past the stationary nozzles 21, 22 with a defined transport velocity.

FIG. 1*b* shows an example of a print bar 102 having three print heads 103 in a section orthogonal to the transport direction 1. The individual print heads 103 are connected with a central control assembly 131 via electrical lines (electrical conductors) 134. The one or more electrical lines 134 are thereby connected to a print head 103 via one or more plugs 133 with accordingly one or more sockets of said print head 103 (not shown). The one or more electrical lines 134 may be designed in order to transfer the print data to a print head 103 and/or to supply the print head 103 with electrical power. A parallel data transmission may thereby take place via a plurality of wires of an electrical line 134. The print data may be provided to the central control assembly 131 from the controller 101 of the printing device 100 via an optical line 132.

The use of a central control assembly 131 for a plurality of print heads 103 leads to relatively long and thus relatively interference-prone electrical lines 134 for the data transmission. Furthermore, the use of a central control assembly 131 does not enable a flexible adaptation of the number of print heads 103 and/or of the print width of a print bar 102.

The aforementioned disadvantages may be avoided in that a respective, dedicated control assembly is provided for every single print head 103 of a print bar 102, which dedicated control assembly is attached directly to the respective print head 103. The length of the electrical lines 134 may thus be reduced to a minimum. Furthermore, the number of print heads in a print bar 102 may thus be flexibly adapted. On the other hand, the installation of individual control assemblies at the individual print heads 103 of a print bar 102 or of a printing device 100 may be linked with a relatively high time cost. In the following, an attachment device is therefore described that enables an efficient and reliable attachment of a control assembly to a print head.

FIGS. 2*a* and 2*b* show an example of an attachment device 200 for a control assembly 221 at a print head 103, in particular at the heat sink 201 of a print head 103. The heat sink 201 of the print head 201 has a groove 205 into which the attachment region 215 of a carrier plate 211 of the control assembly 221 may be introduced. In an exemplary embodiment, the groove 205 has a depth (along the height axis 3) that is sufficient in order to ensure that the carrier plate 211 is held in a stable position, in particular in a stable vertical position, if the attachment region 215 of the carrier plate 211 is located in the groove 205, as is shown by way of example in FIG. 2*b*. For this purpose, in an exemplary embodiment, the dimensions are matched to one another or identical, in particular along the transverse axis 2 and/or along the longitudinal axis 1 of the groove 205 and of the attachment region 215 of the carrier plate 211.

In the example depicted in FIGS. 2*a* and 2*b*, the groove 205 has a chamfer 206 at least at an outer edge or insertion edge 303. Alternatively or additionally, the carrier plate 211 may have a chamfer 216 at a foot (bottom) edge 313 that faces toward the groove 205 upon insertion of the attachment region 215 of the carrier plate 211 into said groove 205. The introduction of the carrier plate 211 into the groove 205 may thus be facilitated.

The control assembly 221 may have a circuit board 222 that is attached to the carrier plate 211, in particular to the retention region 212 of the carrier plate 211, as depicted in FIGS. 2*a* and 2*b*. Alternatively, the retention region 212 of the carrier plate 211 may be possibly be designed directly as a circuit board. One or more electronic components may be arranged on the circuit board 222 in order to provide a defined function of the control assembly 221.

The control assembly 221 may also comprise a contact part 223 at which are arranged one or more connecting elements 133, in particular plugs, that enable it to form one or more plug connections with one or more complementary connecting elements 203 of the print head 103, in particular sockets. In particular, one or more electrically conductive plug connections may thereby be formed, for example for data transmission and/or to supply power to the print head 103. The contact part 223 may be arranged at an angle of 90° relative to the circuit board 222. An arrangement of the control assembly 221 above the print head 103 that is efficient in terms of installation space may thus be enabled.

The contact part 223 may be connected with the circuit board 222 in an electrically conductive manner via an intermediate part 224. In an exemplary embodiment, the circuit board 222, the intermediate part 224, and the contact part 223 may be designed as a continuous, flexible circuit board, wherein the flexible circuit board is curved, in particular by 90°, in the region of the intermediate part 224. The control assembly 221 may thus be provided in a particularly efficient manner. Furthermore, the attachment of the control assembly 221 to the print head 103 may be stabilized via the use of a flexible circuit board, since the control assembly 211 may be supported on the print head 103 via the contact part 223.

FIG. 2*a* shows the position of the nozzle plate 202 of the print head 103, said nozzle plate 202 being arranged downward along the height axis 3, on which nozzle plate 202 are arranged one or more nozzles 21, 22 of the print head 103. The one or more connecting elements 203 and/or the groove 205 of the print head 103 are typically arranged on the side of the print head 103 opposite the nozzle plate 202. The heat sink 201 may be arranged on a contact side 204 of the print head 103, said contact side traveling along the height axis 3, and be connected with said print head 103.

The insertion of a carrier plate 211 into a groove 204 of the (heat) sink 201 of the print head 103 enables an installer to efficiently attach the control assembly 221 to the print head 103. Via an additional latching mechanism, it may be produced that the control assembly 221 remains firmly connected to the print head 103 even given operation of the printing device 100 and the vibrations that are thereby created.

FIGS. 3*a* and 3*b* show, on the left side and right side, respective different embodiments of the carrier plate 211, in particular of the attachment region 215 of the carrier plate 211. Marked on the right side in FIG. 3*a* is a section I-I that corresponds to the section of the attachment device 200 that is depicted in FIG. 2*b*.

The carrier plate 211 may have a recess 301 that extends parallel to the curve of the groove 205 and/or parallel to the insertion edge 303 of the groove 205. The recess 301 may form a dividing line between the attachment region 215 of the carrier plate 211, which is arranged in the groove 205 in the inserted state, and the retention region 212 of the carrier plate 211, which in the inserted state is arranged outside of the groove 205. The recess 301 may be arranged at a height 310 (along the height axis 3), measured from the foot edge 313 of the carrier plate 211, which height 310 corresponds to the depth 310 of the groove 205 as measured from the insertion edge 303.

In the example depicted on the left side of FIGS. 3*a* and 3*b*, the carrier plate 211 has two recesses 301 that, starting from a respective side edge 311 of the carrier plate 211, extend parallel to the foot edge 313 and/or to the head (top) edge 312 of the carrier plate 211 and/or parallel to the insertion edge 303 of the groove 205. In the example depicted on the right side of FIGS. 3*a* and 3*b*, the carrier plate 211 has an inner recess 301 that does not start at a side edge 311 of the carrier plate 211.

As depicted in FIGS. 3*c* and 3*d*, the print head 103 may have a latch 320 at the insertion edge 303 of the groove 205, which latch 320 may be introduced into the recess 301 of the carrier plate 211 in order to clamp the carrier plate 211 inserted into the groove 205. The latch 320, in conjunction with the recess 301, may be designed to prevent the carrier plate 211 from being able to move out of the groove 205, in particular from being pulled out. The latch 320 may thus be designed to prevent a movement of the carrier plate 211 along the height axis 3.

On the left side, FIGS. 3*c* and 3*d* show a heat sink having two latches 320, respectively a latch 320 for both recesses 301 of the carrier plate 211 depicted on the left side of FIGS. 3*a* and 3*b*. Shown on the right side is the use of a central latch 320 that engages in the central recess 301 of the carrier plate 211 depicted on the right side of FIGS. 3*a* and 3*b*. The latch 320 is thereby depicted as a hook 322, for example, that encompasses a leg of the carrier plate 211, which leg is formed via the central recess 301, in order to fix said carrier plate 211.

In the examples depicted in FIGS. 3*c* and 3*d*, the latches 320 are respectively borne so as to be able to pivot about a rotation axis 321. Alternatively or additionally, a displaceable latch may be provided.

FIG. 3*c* shows a view from above of the top side of the print head 103, in particular of the top side of the heat sink 201 of the print head 103. FIG. 3*d* shows the section II-II through the heat sink 201 of the print head 103 that is identified in FIG. 3*c*. FIG. 3*d* thereby also shows a cooling channel 323 of the heat sink 201 through which a cooling medium, in particular water, may be directed in order to cool the heat sink 201 or the print head 103. The cooling medium may be conveyed into or out of the heat sink 201 via the connectors 302.

An arrangement 200 is thus described that enables an efficient and/or toolless installation of a control assembly 221 at a print head 103. A carrier plate 211, in particular a retention plate, may be directed into a groove or into a slot 205 of the cooling cheek 201 of the print head 103. The carrier plate 211 with the control assembly 221 may then be arrested at the print head 103 with a lever or with a latch 320.

In this document, an attachment device 200 for attaching an electronic assembly 221 to a base module 103 is described in particular. The electronic assembly 221 may be designed to supply the base module 103 with electrical power and/or to control the base module 103 and/or to transfer data to the base module 103. The base module 103 may be a print head of a printing device 100.

The attachment device 200 comprises a carrier plate 211, for example a carrier sheet, of the electronic assembly 221 or for the electronic assembly 221. The carrier plate 211 has at least one recess 301 between an attachment region 215 and a retention region 212 of the carrier plate 211. The attachment region 215 may thereby be provided for attaching the carrier plate 211 to the base module 103. The retention region 212 may be provided to bear components of the assembly 221, in particular a circuit board 222. In particular, in the retention region 212 the carrier plate 211 may be designed as a circuit board and/or be mechanically connected with a circuit board 222 of the electronic assembly 221.

Furthermore, the attachment device 200 comprises a support body 201 of the base module 201. The support body 201 may thereby be designed as a heat sink of the base module 103.

The support body 201 may have at least one groove 205 that is designed to accommodate the attachment region 215 of the carrier plate 211. In an exemplary embodiment, the groove 205 is thereby formed complementary to the attachment region 215 of the carrier plate 211. In particular, the groove 205 may have a depth 310, along the insertion direction or along the height direction 3 of the carrier plate 211, which corresponds to the length 310 of the attachment region 215 of the carrier plate 211 along the insertion direction or along the height direction 3. Alternatively or additionally, the groove 205 may exhibit a spreading orthogonal to the surface of the carrier plate 211 that corresponds to the thickness of the attachment region 215 of the carrier plate 211. Alternatively or additionally, the groove 205 may form a cavity with a volume that corresponds to the volume of the attachment region 215 of the carrier plate 211.

By providing a carrier plate 211 with an attachment region 215 whose shape is adapted to the shape of the groove 205 of the support body 201, it may be produced that the carrier plate 211 may be reliably held on or by the support body 201 if the attachment region 215 of the carrier plate 211 is arranged in the groove 205 of said support body 201.

The support body 201 may also comprise at least one latch 320, in particular a mechanical latch or bolt, that is attached to the support body 201 so as to be movable and is designed to by moved to attach the carrier plate 211 in the recess 301 of the carrier plate 211 if the attachment region 215 of the carrier plate 211 is located in the groove 205 of the support body 201. The recess 301 and the latch 320 may thereby be designed such that the carrier plate 211 is fixed or arrested in the groove 205 of the support body 201 via insertion of the latch 320 into the recess 301, in order to prevent a movement of the carrier plate 211 counter to the insertion direction.

An attachment device 200 is thus described for attaching an electronic assembly 221 to a base module 103, in particular to a print head of a printing device 100. The attachment device 200 comprises a carrier plate 211 of the assembly 221 and a support body 201 of the base module 103, wherein the support body 201 has a groove 205 into which the carrier plate 211 may be inserted and arrested by means of a latch 320 that engages in a recess 301 of the carrier plate 211. An efficient and reliable attachment of the assembly 221 to the base module 103 may thus be enabled.

The latch 320, also referred to as a lever in this document, may be designed to be moved into the recess 301 to arrest the carrier plate 211 such that said latch 320 at least partially covers the groove 205. The groove 205 may have a defined clearance orthogonal to the surface of the carrier plate 211. The latch 320 may be designed such that the latch 320 for arresting the carrier plate 211 extends over the entire clearance of the groove 205. A particularly reliable attachment of the assembly 221 to the base module 103 may thus be produced.

The latch 320 may be borne on the insertion edge 303 of the groove 205 so as to be pivotable, which groove 205 faces toward the carrier plate 211 upon insertion of said carrier plate 211. Alternatively, the latch 320 may be borne at the insertion edge 303 of the groove 205 so as to be displaceable. A particularly efficient and comfortable attachment of the assembly 221 to the base module 103 may thus be enabled.

In an exemplary embodiment, the recess 301 extends parallel to the insertion edge 303 of the groove 205, whereby a reliable closing and/or opening of the latch 320 is enabled.

The recess 301 may be arranged at the carrier plate 211 such that an edge of the attachment region 215 of the carrier plate 211 that adjoins the recess 301 travels flush with the insertion edge 303 of the groove 205 and/or flush with the side of the latch 320 facing toward the support body 201 if the attachment region 215 of the carrier plate 211 is arranged in the groove 205. Alternatively or additionally, the recess 301 may be arranged at the carrier plate 211 such that the edge of the retention region 212 of the carrier plate 211 that adjoins the recess 301 travels flush with the side of the latch 320 facing away from the support body 201 if the attachment region 215 of the carrier plate 211 is arranged in the groove 205. A recess 301 of such a design enables a particularly reliable fixing of the assembly 221 to the base module 103.

The carrier plate 211 may have side edges 311 that extend away from the support body 201 if the attachment region 215 of the carrier plate 211 is arranged in the groove 205. The recess 301 may be arranged on a side edge 311 of the carrier plate 211 and/or extend away from a side edge 311 of the carrier plate 211. Alternatively, the recess 301 may be arranged between the two side edges 311 of the carrier plate 211, in particular such that the recess 301 does not extend up to the side edges 311. A recess 301 of such a design enables a particularly reliable fixing of the assembly 221 to the base module 103.

The recess 301 may be designed such that the carrier plate 212 forms a leg in a region adjoining said recess 301. The latch 320 may then be designed as a pivotable hook 322 that, to attach the carrier plate 211, may be pivoted around a rotation axis 321 in order to at least partially enclose the leg. A particularly reliable attachment of the assembly 221 to the base module 103 may thus be produced.

The carrier plate 211 may have a chamfer 216 at a foot edge 313 that faces toward the groove 205 upon insertion into said groove 205. Alternatively or additionally, the groove 205 may have a chamfer 206 at the insertion edge 303 that faces toward the carrier plate 211 upon insertion of said carrier plate 211. A user may thus be enabled to introduce the carrier plate 211 particularly reliably and comfortably into the groove 205 of the support body 201.

The base module 103 may comprise at least one connecting element 203, in particular a socket, on a side 303 at which the groove 205 is arranged. The attachment device 200 may comprise a contact part 223 having at least one complementary connecting element 133, in particular a plug, which is designed to form an electrically conductive and/or optical connection with the connecting element 203 of the base module 301.

The contact part 223 may be mechanically connected with the carrier plate 211, for example via an intermediate part 224. In particular, the assembly 221 may comprise a flexible circuit board that is connected with the carrier plate 211 and the contact part 223, or that forms the contact part 223. The contact part 223 may be attached to the carrier plate 211 such that said contact part 223 forms a support for the carrier plate 211 if the carrier plate 211 inserts into the groove 205 of the support body 201 and if the connecting elements 203, 133 are connected with one another. For this purpose, the contact part 223 may be arranged at an angle of 30° or more, or 45° or more, in particular orthogonal, relative to the carrier plate 211. A particularly stable attachment of the assembly 221 to the base module 103 may be produced via these measures, in particular via the involvement of the connecting elements 133, 203 as a supporting function for the assembly 221.

Furthermore, in this document a print bar 102 is described having one or more print heads 103 that respectively comprise one of the attachment devices 200 described in this document.

Moreover, in this document a printing device 100 is described that comprises the attachment device 200 described in this document.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction or longitudinal axis
2 transverse direction or transverse axis
3 height direction or height axis
21, 22 nozzle
31, 32 column (of the print image)
100 printing device
101 controller
102 print bar
103 base module (print head)
120 recording medium
131 control assembly
132 optical line
133 connecting element (plug)
134 electrical line
200 attachment device
201 support body (heat sink)
202 nozzle plate
203 connecting element (socket)
204 contact side between print head and heat sink
205 groove or slit
206 chamfer of the insertion edge of the groove
211 carrier plate
212 retention region
215 attachment region
216 chamfer of the foot edge of the carrier plate
221 assembly
222 circuit board
223 contact part
224 intermediate part
301 recess
302 heat sink connector
303 insertion edge of the groove
310 length of the attachment region of the carrier plate
311 side edge of the carrier plate

312 head or upper edge of the carrier plate
313 foot or lower edge of the carrier plate
320 latch
321 rotation axis of the latch
322 hook
323 cooling channel

The invention claimed is:

1. An attachment device for attaching an electronic assembly to a base module of a printer, the attachment device comprising:

a carrier plate of the electronic assembly having at least one recess between an attachment region and a retention region of the carrier plate, the retention region being configured to connect to the electronic assembly to secure the electronic assembly to the carrier plate; and a support body of the base module including:

at least one groove configured to accommodate the attachment region of the carrier plate, and at least one latch moveably attached to the support body, the at least one latch being configured to be movable into the at least one recess to attach the carrier plate when the attachment region of the carrier plate is located in the groove of the support body.

2. The attachment device according to claim 1, wherein the latch is configured to be moved into the recess such that the latch at least partially covers the groove.

3. The attachment device according to claim 1, wherein:

the latch is borne at an insertion edge of the at least one groove so as to be pivotable; or the latch borne at an insertion edge of the at least one groove so as to be displaceable.

4. The attachment device according to claim 1, wherein the at least one groove:

has a depth, along an insertion direction of the carrier plate, that corresponds to a length of the attachment region of the carrier plate along the insertion direction;

exhibits a spreading orthogonal to a surface of the carrier plate, the spreading corresponding to a thickness of the attachment region of the carrier plate;

forms a cavity having a volume that corresponds to a volume of the attachment region of the carrier plate; and/or is formed complementary to the attachment region of the carrier plate.

5. The attachment device according to claim 1, wherein the at least one groove:

has a depth, along an insertion direction of the carrier plate, that corresponds to a length of the attachment region of the carrier plate along the insertion direction;

exhibits a spreading orthogonal to a surface of the carrier plate, the spreading corresponding to a thickness of the attachment region of the carrier plate;

forms a cavity having a volume that corresponds to a volume of the attachment region of the carrier plate; and is formed complementary to the attachment region of the carrier plate.

6. The attachment device according to claim 1, wherein:

the at least one groove has an insertion edge that faces toward the carrier plate upon introduction of said carrier plate, and the recess extends parallel to the insertion edge;

the recess is arranged at the carrier plate such that an edge of the attachment region of the carrier plate that adjoins the recess travels flush with the insertion edge of the at least one groove and/or flush with a side of the latch facing toward the support body if the attachment region of the carrier plate is arranged in the at least one groove; and/or the recess is arranged at the carrier plate such that an edge of the retention region of the carrier plate that adjoins the recess travels flush with a side of the latch facing away from the support body if the attachment region of the carrier plate is arranged in the at least one groove.

7. The attachment device according to claim 1, wherein:

the at least one groove has an insertion edge that faces toward the carrier plate upon introduction of said carrier plate, and the recess extends parallel to the insertion edge;

the recess is arranged at the carrier plate such that an edge of the attachment region of the carrier plate that adjoins the recess travels flush with the insertion edge of the at least one groove and/or flush with a side of the latch facing toward the support body if the attachment region of the carrier plate is arranged in the at least one groove; and the recess is arranged at the carrier plate such that an edge of the retention region of the carrier plate that adjoins the recess travels flush with a side of the latch facing away from the support body if the attachment region of the carrier plate is arranged in the at least one groove.

8. The attachment device according to claim 1, wherein:

the carrier plate has two side edges that extend away from the support body if the attachment region of the carrier plate is arranged in the at least one groove; and the recess is arranged at one of the two side edges of the carrier plate, or the recess is arranged between the two side edges of the carrier plate and is spaced from the two side edges.

9. The attachment device according to claim 1, wherein:

the recess is configured such that the carrier plate forms a leg in a region adjoining the recess; and the latch is configured as a pivotable hook that is configured to be pivoted about a rotation axis to at least partially enclose the leg to attach to the carrier plate.

10. The attachment device according to claim 1, wherein:

the carrier plate has a chamfer at a foot edge facing toward the at least one groove upon insertion into the at least one groove; or the at least one groove has a chamfer at an insertion edge facing toward the carrier plate upon insertion of the carrier plate.

11. The attachment device according to claim 1, wherein:

the carrier plate has a chamfer at a foot edge facing toward the at least one groove upon insertion into the at least one groove; and the at least one groove has a chamfer at an insertion edge facing toward the carrier plate upon insertion of the carrier plate.

12. The attachment device according to claim 1, wherein:

the base module comprises at least one connecting element on a side at which the at least one groove is arranged;

the attachment device comprises a contact part having at least one connecting element that is configured to form an electrically conductive and/or optical connection with the connecting element of the base module; and the contact part is mechanically connected with the carrier plate.

13. The attachment device according to claim 12, wherein the contact part is arranged at an angle of 30° or more relative to the carrier plate.

14. The attachment device according to claim 12, wherein the contact part is arranged orthogonal to the carrier plate.

15. The attachment device according to claim 1, wherein:

the carrier plate, in the retention region, is a circuit board and/or is mechanically connected with a circuit board of the electronic assembly;

the support body is a heat sink of the base module;

the base module is a print head of a printing device; and/or the electronic assembly is configured to: supply the base module with electrical power, control the base module, and/or transfer data to the base module.

16. The attachment device according to claim 1, wherein:

the carrier plate, in the retention region, is a circuit board and/or is mechanically connected with a circuit board of the electronic assembly;

the support body is a heat sink of the base module;

the base module is a print head of a printing device; and the electronic assembly is configured to: supply the base module with electrical power, control the base module, and/or transfer data to the base module.

17. The attachment device according to claim 1, wherein the base module is a print head of a printing device.

18. The attachment device according to claim 1, wherein the least one latch is configured to be movable in a direction perpendicular to a direction in which the attachment region is insertable into the groove to move the at least one latch into the at least one recess.

19. An attachment device for attaching an electronic assembly to a base module of a printer, the attachment device comprising:

a carrier plate of the electronic assembly having at least one recess between an attachment region and a retention region of the carrier plate; and a support body of the base module including:

at least one groove configured to accommodate the attachment region of the carrier plate, and at least one latch moveably attached to the support body, the at least one latch being configured to be movable into the at least one recess to attach the carrier plate when the attachment region of the carrier plate is located in the groove of the support body, wherein:

the carrier plate has two side edges that extend away from the support body if the attachment region of the carrier plate is arranged in the at least one groove; and the recess is arranged at one of the two side edges of the carrier plate, or the recess is arranged between the two side edges of the carrier plate and is spaced from the two side edges.

* * * * *